US008960568B2

(12) United States Patent
Chen et al.

(10) Patent No.: US 8,960,568 B2
(45) Date of Patent: Feb. 24, 2015

(54) BRUSH WHEEL TYPED NEBULIZER

(71) Applicants: Wen-Pin Chen, New Taipei (TW); Chiu-Yueh Tung, New Taipei (TW)

(72) Inventors: Wen-Pin Chen, New Taipei (TW); Chiu-Yueh Tung, New Taipei (TW)

( * ) Notice: Subject to any disclaimer, the term of this patent is extended or adjusted under 35 U.S.C. 154(b) by 186 days.

(21) Appl. No.: 13/794,688

(22) Filed: Mar. 11, 2013

(65) Prior Publication Data

US 2014/0252124 A1 Sep. 11, 2014

(51) Int. Cl.
*B05B 3/08* (2006.01)
*B05B 9/08* (2006.01)

(52) U.S. Cl.
CPC ..... *B05B 3/08* (2013.01); *B05B 9/0866* (2013.01)
USPC ..... 239/221; 239/218.5; 239/214.21; 239/7; 239/380; 239/338

(58) Field of Classification Search
CPC ..... B05B 3/1035; B05B 3/1042; B05B 3/08
USPC ..... 239/218.5, 7, 338, 380, 225.1, 263.1, 239/263.3, 214.21
See application file for complete search history.

(56) References Cited

U.S. PATENT DOCUMENTS

| | | | | | |
|---|---|---|---|---|---|
| 1,065,365 | A | * | 6/1913 | Higgins | 366/13 |
| 2,326,823 | A | * | 8/1943 | Brend | 239/218.5 |
| 2,763,510 | A | * | 9/1956 | Di Nicola | 239/220 |
| 3,047,237 | A | * | 7/1962 | Tambolleo | 239/215 |
| 5,314,119 | A | * | 5/1994 | Watt | 239/220 |
| 5,697,555 | A | * | 12/1997 | Robinson | 239/219 |
| 5,842,642 | A | * | 12/1998 | Plasko | 239/220 |

* cited by examiner

*Primary Examiner* — Len Tran
*Assistant Examiner* — Tuongminh Pham

(57) ABSTRACT

The present invention provides a brush wheel typed nebulizer, comprising: a drive device; a spiral pump, including a body, an outer sleeve, in which the outer periphery of the body is installed with at least a helicoid member closely attached to an inner sleeve having a flow opening inside the outer sleeve; a brush wheel, configured with multiple implant holes and having brush hairs forming at least a ditch; a sleeve lid, on which a notch is configured in correspondence with the end of the brush hair, and an inner bulge acting conjunctively with the end of the brush hair and having multiple guide grooves. With such a design, it is possible to fling off the highly viscous liquid attached on the brush hair to create atomized liquid of extremely tiny microdrops.

10 Claims, 7 Drawing Sheets

BRUSH WHEEL TYPED NEBULIZER

BACKGROUND OF THE INVENTION

1. Field of the Invention

The present invention generally relates to a nebulizer; in particular, it relates to a brush wheel typed nebulizer suitable for liquid of high viscosity, in which an end of the spiral pump is configured fixedly in wrap with a brush wheel, and the brush wheel is implanted with brush hairs having at least a ditch. The brush hair along with the sleeve lid exteriorly installed and having the notch and the inner bulge can together create an interferential obstruction, so that it is possible to further allow the brush hair to generate a strong centrifugal force in order to fling off the liquid attached on the brush hair thereby obtaining extremely tiny microdrops.

2. Description of Related Art

Nebulizers have been long comprehensively applied in various fields of our daily lives; from wetting, fragrance, landscaping equipments in civil utilizations, atomizing inhalation treatment devices for medical purpose, thermal control apparatus for dustless chambers in precision industry, to greenhouse environment control for agricultural development, simply naming a few, the examples of nebulizer applications are omnipresent. Currently, numerous forms and sorts of nebulizer devices or atomizers are available, including ultrasonic ceramic oscillation typed, high pressure air typed, motor-driven high pressure pumped and the like. However, with respective and profound examinations, for handheld and battery-powered applications, only the ultrasonic ceramic oscillation typed is more likely to meet the requirements. For example, as the structure shown in the disclosure of U.S. Pat. No. 6,357,671, the device for liquid nebulization is configured with a body, and inside the body a V-shaped nebulizer container is installed on the upper side; meanwhile, under the V-shaped nebulizer container there installs a vibration membrane. Moreover, under the body, a vibration piezoelectric converter (i.e., supersonic wave ceramic) is installed in correspondence with the vibration membrane, in which the vibration converter is additionally connected to many complicated and interconnected components like vibration actuator, sonar detector as well as control unit and so forth. Such a prior art technology is not only complicated in structure, but the circuits and components installed therein may cause difficulties to a certain extent with regards to maintenance and examination processes; moreover, it can atomize simply the liquid of no or low viscosity, but may become completely useless for nebulizing liquid of viscosity with existence of gravity effect.

In addition, another prior art product for liquid atomization/nebulization is set forth in the contents of U.S. Pat. No. 7,467,786, wherein the disclosed structure essentially features a heat groove installed on the top side, and a through V-shaped opening is configured at the center of the heat groove; besides, under the heat groove and by means of a fixation component, a heat groove fixation block having a recessed chamber at its center is fixedly installed. A conductive ring is sandwich installed between the heat groove and the heat groove fixation block, the center of the conductive ring is embedded with a nebulizer vibrator (supersonic wave ceramic), and the nebulizer vibrator is installed in connection with a connection end penetrating through the heat groove fixation block and extending downward. Moreover, the recessed chamber of the heat groove fixation block, at the top, is configured under the nebulizer vibrator with a vibration arm having a connection end which is connected to complicated circuits. Similarly, such a prior art product can create nebulization results only on liquid of no or low viscosity, and complicated electric power enabled circuits may become challenging for maintenance and examination processes, so successful atomization can not be achieved for liquid of high viscosity with gravity effect. Or, even the liquid is barely atomized, the viscous liquid molecules can not be well broken, so the micro-particle effect may be undesirable and the generated result is still in a liquid form rather than nebulized microdrops.

Furthermore, another prior art structure can be shown in the contents of U.S. Pat. No. 6,152,383, wherein the disclosed structure is internally configured with a containing chamber, a pipe-wise wave guide is configured inside the containing chamber, and a transfer medium is loaded in a holding chamber defined inside the containing chamber. Also, a supersonic wave vibrator is installed at the bottom side of the pipe-wise wave guide, and an electronic drive circuit is connected to the supersonic wave vibrator to control the operations thereof. The pipe-wise wave guide may be formed in a single piece along with the containing chamber, or else respectively fabricated and fixedly connected thereto, and the supersonic wave vibrator includes a wave generation area installed on the inner surfer of the pipe-wise wave guide. When the electronic drive circuit activates the supersonic wave vibrator, the wave generation area creates a range of supersonic wave which can be transferred from the wave range and guided to the transfer medium by means of the pipe-wise wave guide, thus that supersonic waves in the holding chamber of the containing chamber can be created, which can break up and pass through the surface tension of the transfer medium. In addition, through holes for transfer medium circulation can be further installed in the holding chamber of the pipe-wise wave guide so as to improve the atomization effect thereof. Once again, such a prior art product can create nebulization results only on liquid of no or low viscosity, and complicated electric power enabled circuits may also cause troubles in maintenance and examination processes, so successful atomization for liquid of high viscosity with gravity effect can not be achieved at all.

Yet, a supersonic wave nebulizer device is disclosed in the contents of U.S. Pat. No. 7,347,889, as shown in FIG. 17. The supersonic wave vibrator thereof is installed in a separable groove part, and a gasketing component is disposed around the supersonic wave vibrator. Also, a ring-wise disc is fixed onto a plate which can is allowed to be opened, and the ring-wise disc presses on the gasketing component and is conjunctively placed over the surface of the supersonic wave vibrator so that the supersonic wave vibrator is water-proofed within the groove part. The groove part is configured with a through hole at the bottom, and a lead work extends therein to the exterior of the through hole. The supersonic wave vibrator as shown in FIG. 18 is bonded to the groove part of the separable plate in a water-proof way by means of the filling compound, rather than using the gasketing component and the ring-wise disc. The supersonic wave vibrator includes a lead work which extends outwardly and penetrates the through hole configured at the bottom of the groove part, in which the penetrating lead work is stuffed by the filling compound thereby achieving the water-proofed sealing thereof between the through hole and the lead work. FIG. 19 shows a separable plate which is configured with a through hole, in which the supersonic wave vibrator can be installed on the lower surface of the separable plate thereby allowing the surface of the vibrator to be fixed to the through hole. In order to allow the separable plate to be safely fixed to the supersonic wave vibrator, a security component may be firmly attached to the bottom of the separable plate and then the supersonic wave vibrator is fixed to the separable plate, which can be achieved by placing the gasketing component at the upper and lower sides around the supersonic wave vibrator. Whereas such a prior art work can create nebulization results only on liquid of no or low viscosity, and similarly complicated electric power enabled circuits may also cause troubles in maintenance and examination processes, so successful atomization for liquid of high viscosity with gravity effect can not be achieved.

It can be concluded that prior art products can work only on water or water-based liquids; but, for oleaginous fluids having high viscosity and strong adhesive force, they may fail completely. The reason lies in the nebulizer structure composed by supersonic wave ceramic sheets in such prior art products. The operation principle thereof is that the supersonic wave ceramics convert the electronic signal coming from the drive electric power into mechanical energy in a vibration form, and the generated vibration energy is directly placed into water thereby forming cavities therein. When the cavity bursts, the water bond can be broken thus acquiring fine, atomized water air. However, if the water is substituted by oleaginous fluids, then the energy from conventional supersonic wave vibration is not able to break the bond between oil molecules to generate such cavities, so the atomization effect can not be achieved. In addition, the integral structure of the prior art ceramic supersonic wave nebulizer essentially aims to convert from the electric power of the battery to the high frequency electronic signal of high voltage, and then to drive the ceramic sheets to transform electric energy to mechanical energy for operations, in which the conversion loss of the electronic circuits as well as the efficiency loss in the electro-mechanical K-factor of the ceramic sheets may exist all along the path, so in total the entire performance may drop to lower than 50%. As such, the applicable ranges and performances of liquid nebulization are greatly restricted. Since such a supersonic wave vibration approach is ineffective for highly viscous liquids due to the factor of surface tension, the atomization operation may fail so that its feasibility and utilization are significantly reduced.

Furthermore, in recent years, with regards to beauty and cosmetics application markets, a Japanese company SK-II first developed a type of micro-nebulizer device enabled by handheld batteries for the atomization of body powder foundation having high thickness and viscosity. Such a product applies the battery-enabled switching converter to convert high voltage electrostatics, then destroys the surface tension of the liquid power foundation by means of high potential difference, and subsequently blows power foundation micro-drops out of a nozzle by using electrostatic-generated anion airflows thereby acquiring the desired atomization effect. However, electric shock events did frequently occur in users because of high voltage electrostatics used in this product for operations, so the government of United States issued the sales prohibition order and this product was accordingly rejected by consumers. Without any new nebulizer substations providing safer and more efficient aspects, the beauty and cosmetics consumer market is so far in a sort of vacuum state, which is also a critical point that the industry and consumers expect to break through. Accordingly, the inventors of the present invention have considered about this niche and finally acquired brand new ideas for casting off the limits caused by conventional nebulizer methods and structures, thus reducing the efficiency losses generated by complicated electric energy conversions and simplifying the adopted mechanical operations so as to achieve the objectives of smaller size, low energy consumption and high nebulization performance and feasibility for handheld devices, thereby providing a nebulizer suitable for liquids of high viscosity which satisfies requirements on innovation, advancement as well as industrial utilization for patent applications.

SUMMARY OF THE INVENTION

To resolve the drawbacks as previously set forth, the major objectives of the present invention are to provide a brush wheel typed nebulizer suitable for highly viscous liquids which can cast off the limits caused by conventional nebulization methods and structures, thus reducing the efficiency losses generated by complicated electric energy conversions and simplifying the adopted mechanical operations in order to achieve the objectives of smaller size, low energy consumption and high nebulization performance and feasibility for handheld devices, thereby overcoming the difficulties found in existing technologies.

To describe the issues that the present invention is intended to resolve, it can be noticed that nebulizers have been long comprehensively applied in various fields of our daily lives; from wetting, fragrance, landscaping equipments in civil utilizations, atomizing inhalation treatment devices for medical purpose, thermal control apparatus for dustless chambers in precision industry, to greenhouse environment control for agricultural development, simply naming a few, the examples of nebulizer applications are omnipresent. Currently, numerous forms and sorts of nebulizer devices or atomizers are available, including ultrasonic ceramic oscillation typed, high pressure air typed, motor-driven high pressure pumped and the like. However, with respective and profound examinations, for handheld and battery-powered applications, only the ultrasonic ceramic oscillation typed is more likely to meet the requirements. The devices for successfully achieving liquid nebulization effects, as described in the disclosures of U.S. Pat. Nos. 6,357,671, 7,467,786, 6,152,383 and 7,347,889, the structures thereof are not only complicated, and the configurations of such internal circuits as well as components cause significant difficulties in maintenance and examination processes, and also the devices themselves may only work on liquids of no or low viscosity, but become completely inoperable for highly viscous liquids with gravity effect. It can be concluded that, due to such incapability for highly viscous liquids, prior art products can work only on water or water-based liquids; but, for oleaginous fluids having high viscosity and strong adhesive force, they may fail in effect. The reason lies in the nebulizer structure composed by supersonic wave ceramic sheets in such prior art products. The operation principle thereof is that the supersonic wave ceramics convert the electronic signal coming from the drive electric power into mechanical energy in a vibration form, and the generated vibration energy is directly placed into water thereby forming cavities therein. When the cavity bursts, the water bond can be broken thus acquiring fine, atomized water air. However, if the water is substituted by oleaginous fluids, then the energy from conventional supersonic wave vibration is not able to break the bond between oil molecules to generate such cavities, so the atomization effect can not be achieved. In addition, the integral structure of the prior art ceramic supersonic wave nebulizer essentially aims to convert from the electric power of the battery to the high frequency electronic signal of high voltage, and then to drive the ceramic sheets to transform electric energy to mechanical energy for operations, in which the conversion loss of the electronic circuits as well as the efficiency loss in the electro-mechanical K-factor of the ceramic sheets may exist all along the path, so in total the entire performance may drop to lower than 50%. As such, the applicable ranges and performances of liquid nebulization are greatly restricted. Since such a supersonic wave vibration approach is ineffective for highly viscous liquids due to the factor of surface tension, the atomization operation may fail so that its feasibility and utilization are significantly reduced. Also, a Japanese company SK-II first developed a type of micro-nebulizer device powered by handheld batteries for the atomization of body powder foundation having high thickness and viscosity. However, such a product applies the battery-enabled switching converter to convert high voltage electrostatics, then destroys the surface tension of the liquid power foundation by means of high potential difference, and subsequently blows power foundation microdrops out of a nozzle by using electrostatic-generated anion airflows thereby acquiring the desired atomization effect. Unfortunately, electric shock events did frequently occur in users because of high voltage electrostatics used in this product for operations, so the government of United States issued the sales prohibition order and this product was accordingly rejected by consumers. Without any new nebulizer substations providing safer and more efficient aspects, the beauty and cosmetics consumer market is so far in a sort of vacuum state, thus leading to great inconvenience for consumers.

Consequently, to achieve the aforementioned objectives, the present invention provides a brush wheel typed nebulizer particularly suitable for liquids of high viscosity, comprising:

a drive device, including a motor and a gear shifting mechanism, in which the gear shifting mechanism is disposed in front of the motor and configured with a buckling part;

a spiral pump, installed on the gear shifting mechanism of the drive device and comprising a body, an outer sleeve, in which the outer periphery of the body is installed with at least a helicoid member closely attached to an inner sleeve having a flow opening inside the outer sleeve, and in which an end of the body is configured with an axis, and an end of the axis is configured with a combination part corresponding to the buckling part of the gear shifting mechanism in the drive device;

a brush wheel, closely fixed in wrap to the exterior of the helicoid member of the spiral pump and the axis thereof, wherein the brush wheel has a U-shaped inner wall and an axial hole is configured at the center in order to correspond to the exterior of the helicoid member of the spiral pump and the axis thereof, and also multiple implant holes are configured on the brush wheel and brush hairs having at least a ditch are disposed in the implant holes, in which the brush hair and the helicoid member of the spiral pump are formed in a symmetric spiral line arrangement; and a sleeve lid, installed on the exterior of the brush wheel, in which, at the center thereof, an axial hole corresponding to the axis of the body of the spiral pump is configured, a notch is configured on the sleeve lid in correspondence with the brush hair end of the brush wheel, and an inner bulge is installed at the lower part on one side of the notch, acting conjunctively with the brush hair end and having multiple guide grooves.

Moreover, the brush hair end of the brush wheel according to the present invention is installed with a conical head.

More preferably, the gear shifting mechanism according to the present invention consists of multiple mutually engaged worms, worm gears or spur gears.

More preferably, the buckling part in the gear shifting mechanism of the drive device according to the present invention is a star-shaped gear groove.

More preferably, the combination part of the spiral pump according to the present invention is in a star-shaped gear profile.

More preferably, the brush hair of the brush wheel according to the present invention is elastic.

More preferably, the guide groove of the inner bulge in the sleeve lid according to the present invention is a triangular guide groove.

With the disclosed design, the present invention allows to draw the liquid through the spiral pump to the brush wheel and provides a suitable pressure to squeeze the liquid out of the brush wheel from the aperture of the implant hole in the brush wheel along the ditch on the brush hair, in which an interferential impeding and strong centrifugal force can be generated by means of the elastic brush hairs in the brush wheel and the inner bulge on the notch of the sleeve lid, so as to fling off the liquid attached on the brush hair thereby enabling a nebulizer device applicable for highly viscous liquids featuring the atomized liquid ejection of extremely fine microdrops.

DETAILED DESCRIPTION OF THE PREFERRED EMBODIMENTS

To facilitate thorough appreciation of features, contents and advantages of the present invention as well as effects the present invention is capable of, the present invention is hereunder illustrated in details by means of embodiments with reference to appended drawings. However, the drawings referred by the present disclosure are essentially for the purpose of exemplary and auxiliary descriptions, not necessarily presenting the actual ratios and precise allocations utilized in implementing the present invention. It should be noticed, consequently, that the scope of actual implementations according to the present invention is not to be restricted by such ratio and allocation relationships depicted in the appended diagrams.

Figure 1:
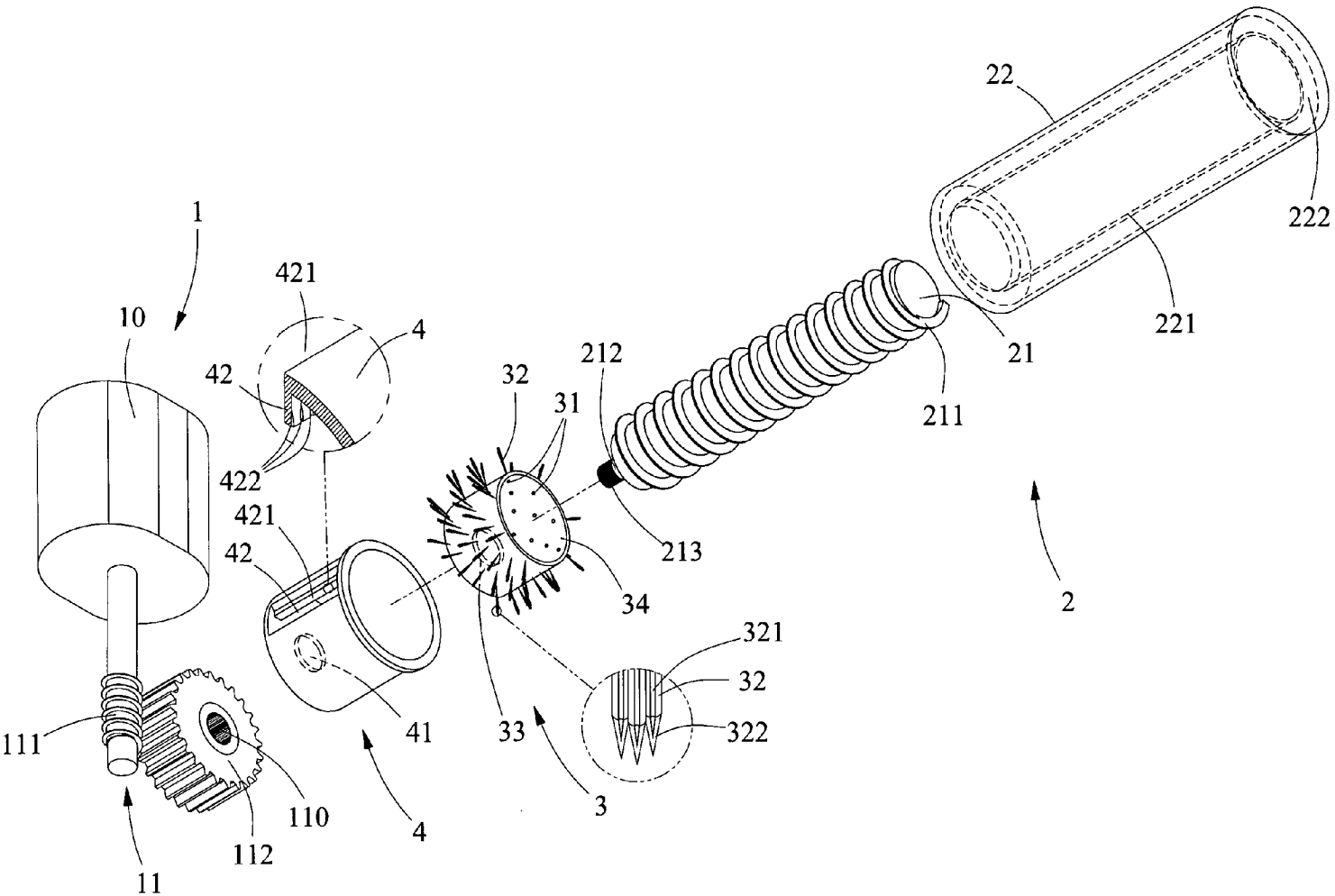
FIG. 1 shows a stereo disassembly view of the present invention.
Figure 2:
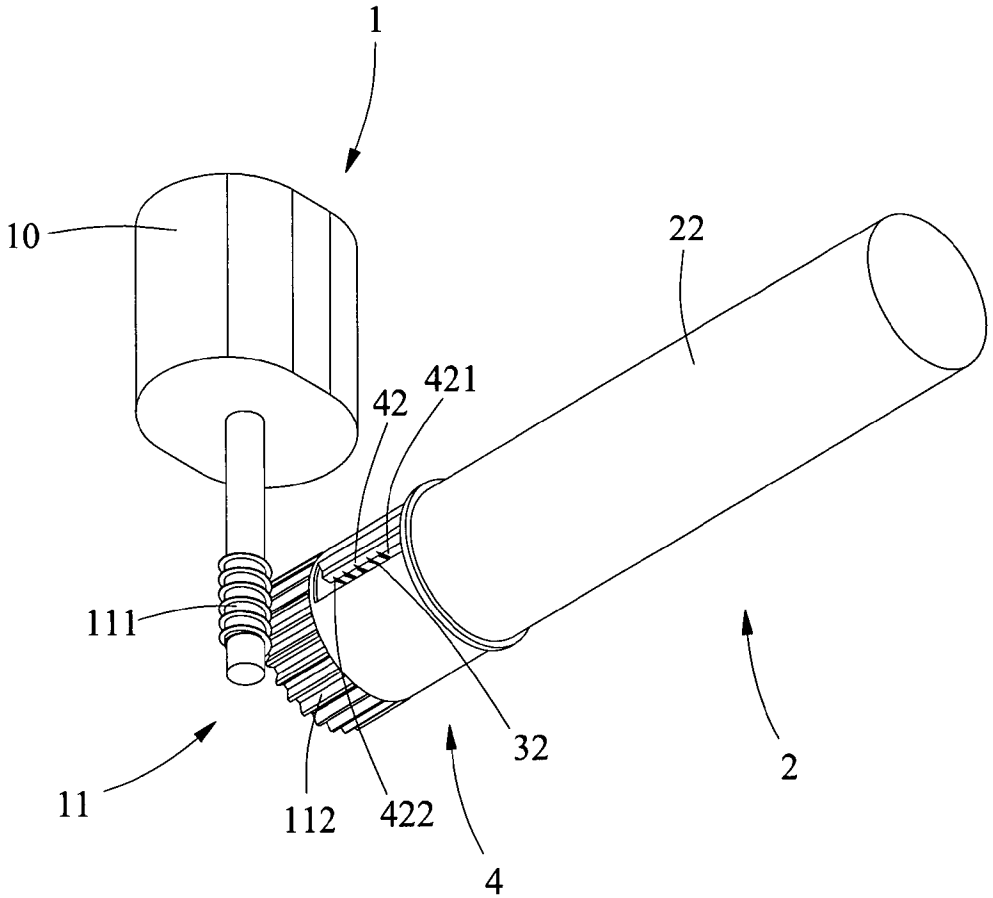
FIG. 2 shows a stereo assembly view of the present invention.
Figure 3:
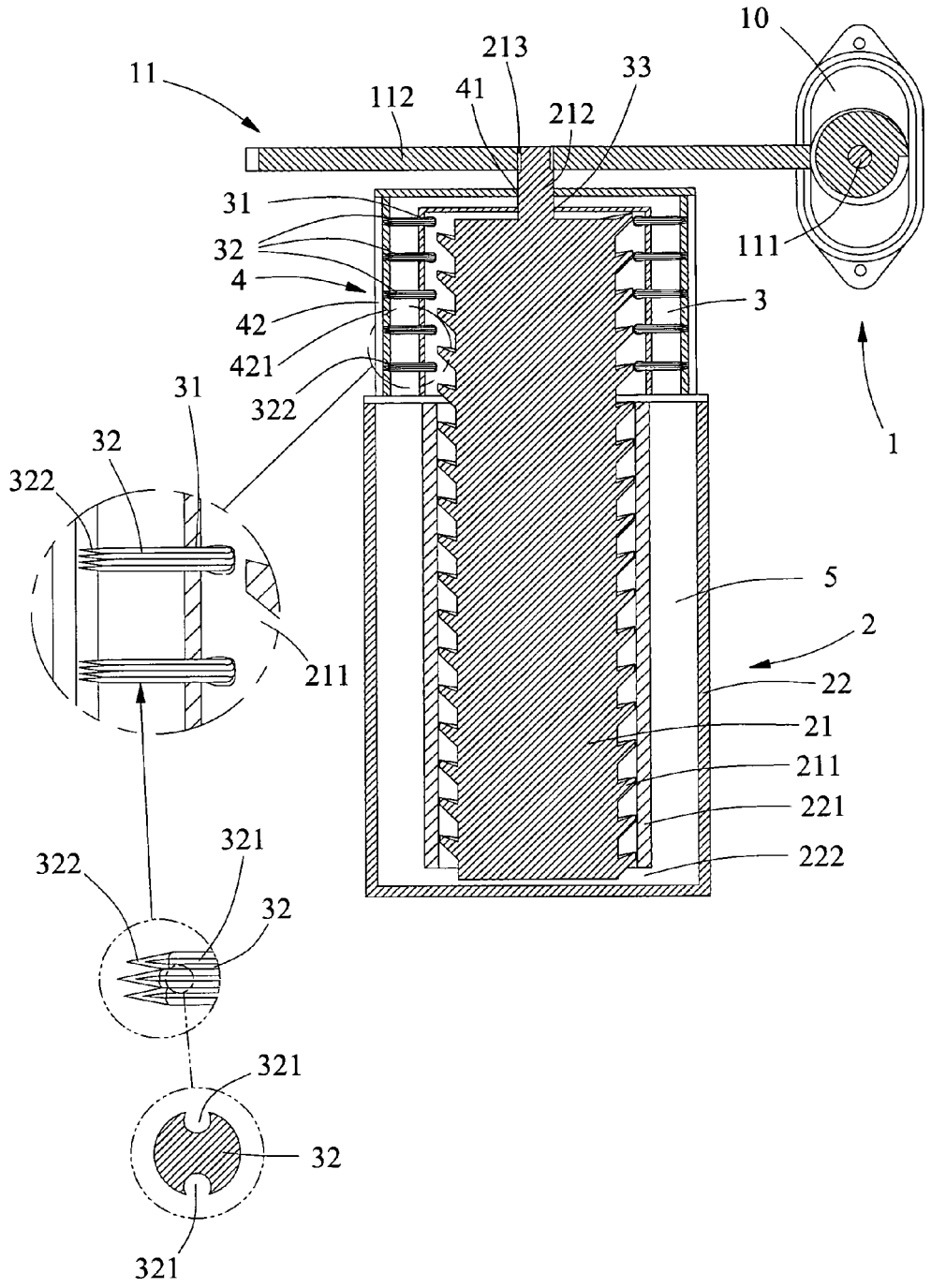
FIG. 3 shows an assembly cross-section view of the present invention.

Referring initially to FIGS. 1, 2 and 3, a stereo disassembly view, a stereo assembly view as well as an assembly cross-section view of the present invention are respectively shown, wherein the brush wheel typed nebulizer in a preferred embodiment according to the present invention comprises a drive device 1, a spiral pump 2, a brush wheel 3 and a sleeve lid 4.

Figure 2A:
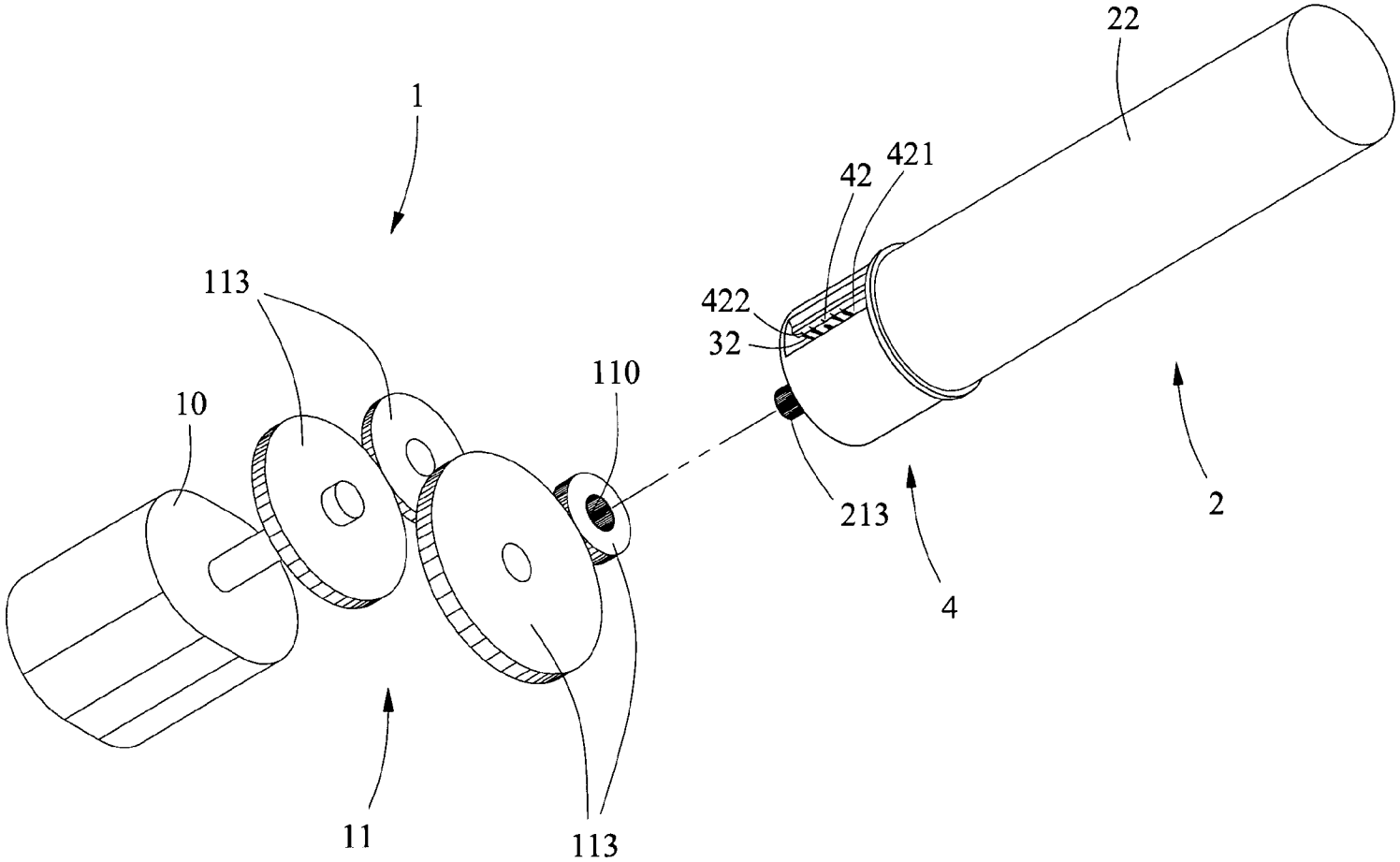
FIG. 2A shows a diagram for an embodiment of the gear shifting mechanism according to the present invention.

The aforementioned drive device 1 includes a motor 10, and a gear shifting mechanism 11 installed on the front side of the motor 10. The gear shifting mechanism 11 is configured with a buckling part 110 and can consist of mutually engaged worms 111 or worm gears 112 (as shown in FIGS. 1 to 3), but the present invention is by no means limited thereto, which can be also plural mutually engaged spur gears 113 (refer to another embodiment of the gear shifting mechanism according to the present invention, as shown in FIG. 2A), or any other engaged speed reducer gear trains, which are all considered to be within the scope of the present invention. Its purpose is to, for the motor 10 featuring high rotation speed and low torque, slow down the rotation speed and increase the torque. In addition, the bucking part 110 in the gear shifting mechanism 11 of the drive device 1 in the present embodiment is a star-shaped gear groove, which can be of other profiles and are included within the scope of the present invention.

The aforementioned spiral pump 2 is installed on the gear shifting mechanism 11 of the drive device 1, comprising a body 21 and an outer sleeve 22, in which the outer sleeve 22 is internally installed with an inner sleeve 221 and a flow opening 222 is also configured under the inner sleeve 221. Meanwhile, a liquid 5 is contained between the outer sleeve 22 and the inner sleeve 221, which is allowed to flow into the inner sleeve 221 by way of the flow opening 222 below the inner sleeve 221, and the body 21 is installed on the inner sleeve 221 inside the outer sleeve 22. The outer periphery of the body 21 is installed with at least a helicoid member 211 attached to the inner sleeve 221 of the outer sleeve 22, and the body 21 in the spiral pump 2 of the present embodiment is a of circular straight cylinder shape, but may be of other profiles as well, which are all within the scope of the present invention. Furthermore, an axis 212 is configured on an end of the body 21, and the end of the axis 212 is installed with a combination part 213 which corresponds to the buckling part 110 of the gear shifting mechanism 11 in the drive device 1 such that the spiral pump 2 can be arbitrarily attached or detached to/from the drive device 1. Besides, in the present embodiment, the combination part 213 is of a star-shape gear shape, but it certainly can be of any other suitable profiles which are all within the scope of the present invention. At the same time, the spiral pump 2 is an Archimedes spiral pump in the present embodiment.

Figure 4:
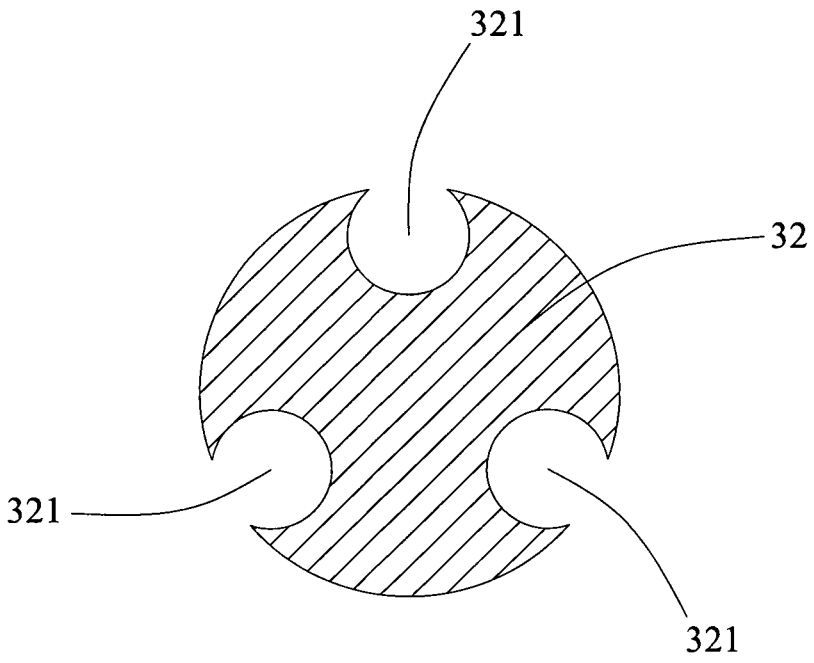
FIG. 4 shows a diagram for an embodiment of the ditch in the brush hair according to the present invention.
Figure 5:
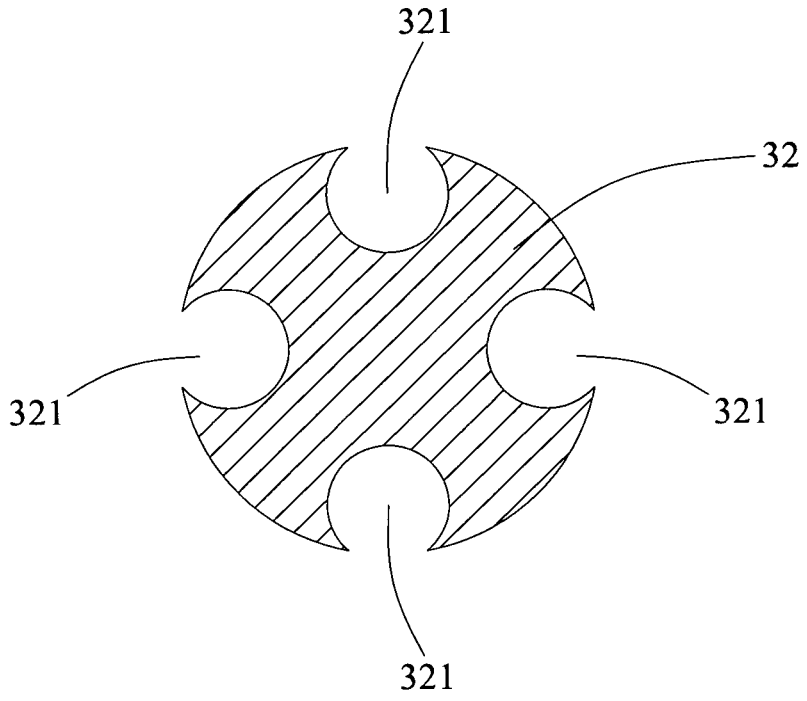
FIG. 5 shows a diagram for another embodiment of the ditch in the brush hair according to the present invention.

The above-said brush wheel 3 is closely fixed in wrap to the exterior of the helicoid member 211 of the spiral pump 2 and the axis 212 thereof. The brush wheel 3 has a U-shaped inner wall 34 and an axial hole 33 is configured at the center in order to correspond to the exterior of the helicoid member 211 of the spiral pump 2 and the axis 212 thereof. In addition, multiple implant holes 31 are configured on the brush wheel 3 and brush hairs 32 having at least a ditch 321 are disposed in the implant holes 31. Herein the brush hair 32 demonstrates elastic characteristics. Moreover, in the present embodiment, two ditches 321 are configured in the brush hair 32, and the brush hair 32 along with the helicoid member 211 of the spiral pump 2 together form a symmetric spiral line arrangement; e.g., the two ditches 321 presented by the ditches 321 of the brush hair 32 as shown in FIGS. 1 to 3; however, the present invention is by no means limited thereto, but can be of other numbers and arrangements which are all considered to be within the scope of the present invention (for example, referring to FIG. 4, a diagram for another embodiment of the ditches in the brush hair 32 according to the present invention, wherein the ditches 321 of the brush hair include three ditches 321, and also referring to FIG. 5, a diagram for yet another embodiment of the ditches in the brush hair 32 according to the present invention, wherein the ditches 321 of the brush hair include four ditches 321. Furthermore, the end of the brush hair 32 in the brush wheel 3 is configured with the conical head 322 of needle tip.

The previously described sleeve lid 4 is installed on the exterior of the brush wheel 3 and an axial hole 41 is configured at the center thereof in correspondence with the axis 212 of the body 21 in the spiral pump 2. A notch 42 is installed on the sleeve lid 4 in correspondence with the end of the brush hair 32 of the brush wheel 3, and, at the lower part on one side of the notch 42, an inner bulge 421 acting conjunctively with the end of the brush hair 32 of the brush wheel 3 and having multiple guide grooves 422 is also installed. In the present embodiment, the guide groove 422 is a triangular guide groove, but the present invention is not limited thereto, various guide grooves allowable for direction guidance can be applied and are all within the scope of the present invention.

Figure 6:
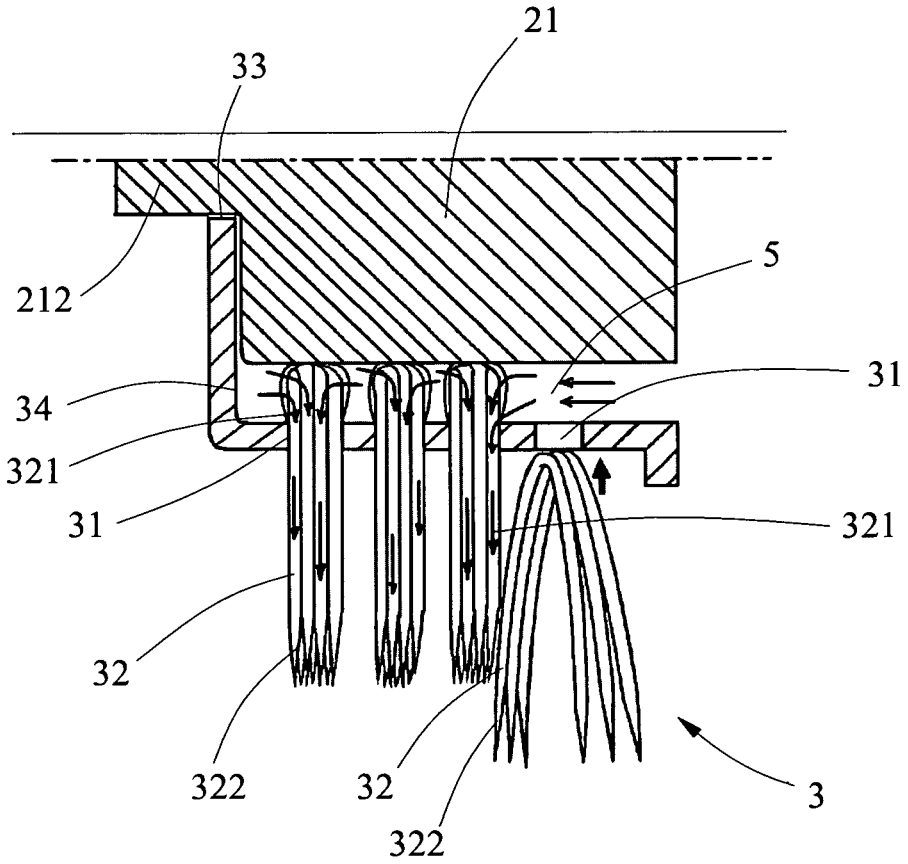
FIG. 6 shows a diagram for the actions of the spiral pump and the brush wheel with the liquid according to the present invention.
Figure 7:
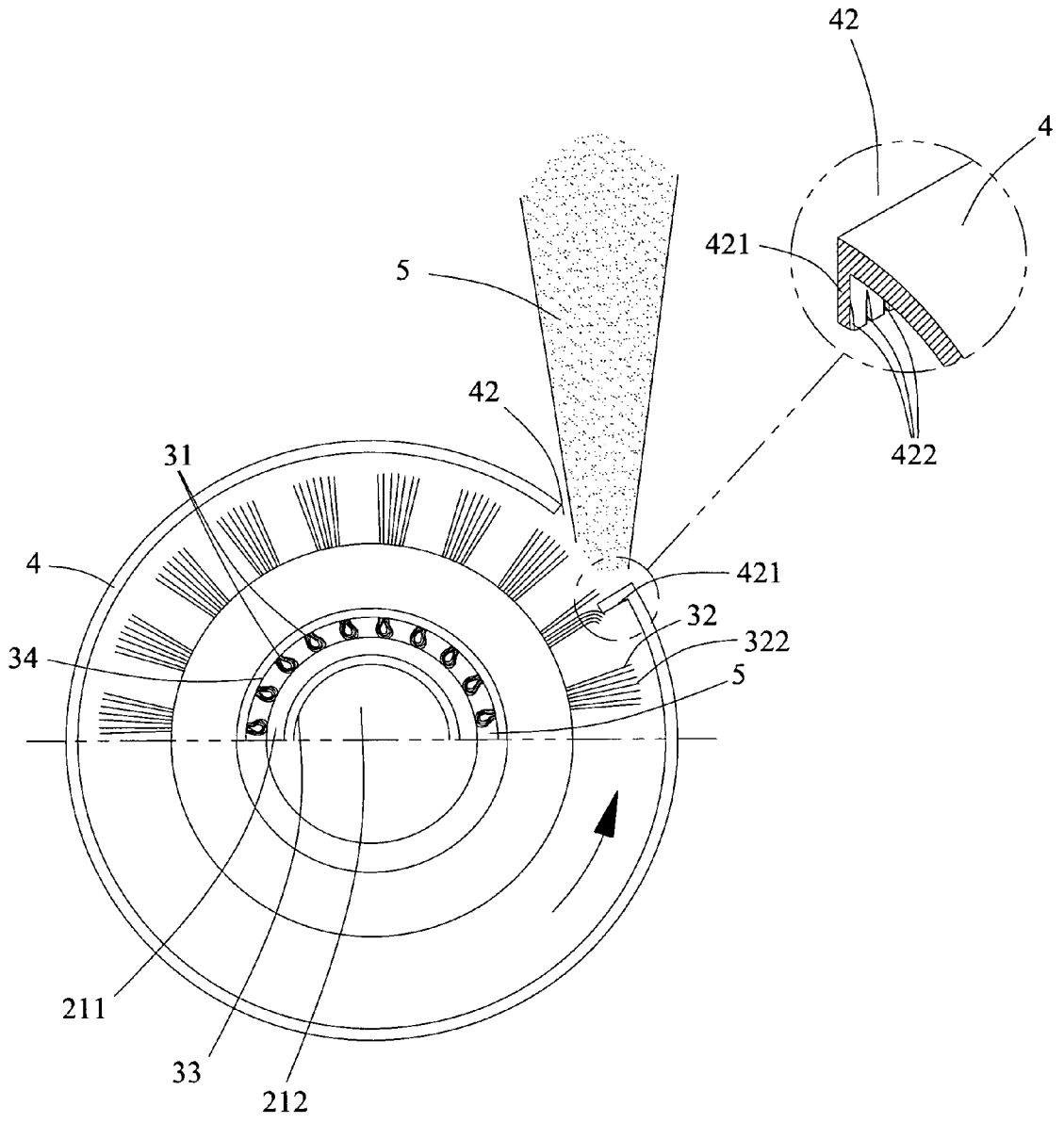
FIG. 7 shows a diagram for the actions of the brush wheel and sleeve lid with the liquid according to the present invention.

Refer next to FIGS. 6 and 7, wherein a diagram of an embodiment for illustrating actions between the liquid and the spiral pump and the brush wheel according to the present invention, as well as a diagram of an embodiment for illustrating actions between the liquid and the brush wheel and the sleeve lid according to the present invention, are respectively shown. In the present invention, the liquid 5 is contained inside the spiral pump 2 (i.e., between the body 21 having the helicoid member 211 and the outer sleeve 22). Essentially, the combination part 213 configured at the axis 212 of an end of the body 21 can constitute an attach key so as to fixedly fasten in buckles to the corresponding buckling part 110 of the gear shifting mechanism 11 in the drive device 1. The present embodiment applies the rotation of the micro DC motor 10, in conjunction with the gear shifting mechanism 11 (e.g., speed reducer gear trains), to drive the Archimedes spiral pump such that the helicoid member 211 thereof can spin in the inner sleeve 221 having the flow opening 222 inside the outer sleeve 22. Since the spiral pump 2 is a circular cylinder component and at least a helicoid member 211 is installed thereon, when the helicoid member 211 is driven to rotate by the motor 10, the spiral pump 2 can operate and push the liquid 5 loaded between the inner sleeve 221 and the outer sleeve 22 to arrive at the inner sleeve 221 by way of the flow opening 222 installed under the inner sleeve 221. Meanwhile, a small gap is maintained between the helicoid member 211 and the inner sleeve 221 installed inside the outer sleeve 22, so the pumping action and pressure can be created thereby further drawing the liquid 5 up to the brush wheel 3 and providing an appropriate pressure to squeeze the liquid 5 out of the brush wheel 3 from the aperture of the implant hole 31 for implantation of the brush hair 32 in the brush wheel 3 along the ditch 321 on the brush hair 32, such that the liquid 5 can reach the brush wheel 3 all the way straight along the spiral pump 2 without any other assistive pipes or connections (as shown in FIG. 6). Furthermore, in the spiral pump 2 according to the present invention, the body 21 having the helicoid member 211 can operate closely with the inner wall 34 of the brush wheel 3 such that the brush wheel 3 and the body 21 of the spiral pump 2 having the helicoid member 211 can be tightly combined together thus allowing the liquid 5 to be transferred by pressure toward the axis 212 along the helicoid member 211. In addition, the brush wheel 3 is installed on the spiral pump 2 and wrapped on the exterior on one side of the helicoid member 211 of the body 21, so the viscous oleaginous fluid 5 of low liquidity and very high adhesive force and high surface tension can be effectively atomized by means of the brush wheel 3. In other word, a extremely small surface exists on the individual brush hair 32, and the oily liquid 5 sticking to the brush hair 32 can only attach onto the surface of the independent brush hair 32, rather than converging to form an entire layer or mass of large oil drop liquid 5; in this way, the adhesive force and the surface tension of the oleaginous fluid 5 can be diverged to the minimum. Next, since the brush wheel 3 abuts against the body 21 including the helicoid member 211 in the spiral pump 2 to apply the spin movement and an inner bulge 421 slightly interfering with the brush hair 32 is additionally disposed on the spin path of the brush hair 32, further due to the installation of multiple guide grooves 422 on the inner bulge 21 in the present invention, therefore, when the brush hair 32 spins and passes the inner bulge 421, the direction thereof can be accurately guided by such guide grooves 422 thereby preventing undesirable declinations. Also, the brush hair 32 is bended because of obstructions from the inner bulge 421, and then rapidly restores to its original straight state right away because of the elasticity in the material of the brush hair 32, after the brush hair 32 passes the guide grooves 422 in the bulge 421. Herein a great centrifugal force can be generated during this transient transformation of the brush hair 32 from being bended to straight, which is sufficiently powerful to fling the liquid 5 constituting an oil film attached on the brush hair 32 off the brush hair 32 thus resulting in ejected fine microdrops. In this way, the objective for nebulization of oleaginous fluids 5 can be achieved (as shown in FIG. 7). In the present invention, the installation of the at least a ditch 321 on the brush hair 32 of the brush wheel 3 aims to provide the flow guidance for the liquid 5. Furthermore, the outer end of the brush hair 32 is configured with a conical head (needle tip) which can lessen the surface as well as the adhesive force of the oleaginous fluid 5 such that the fluid 5 can be more conveniently detached from the brush hair 32 by the centrifugal force. Moreover, the inner bulge 421 including the guide groove 422 and the ditch 324 of the brush hair 32 can together act to guide the direction of the flung liquid 5 such that microdrops of the liquid 5 separated from the end of the brush hair 32 can depart from the brush wheel 3 along the tangent line in accordance with the circular center of the brush wheel 3 without random, scattering consequences.

With the disclosed design, the present invention allows to draw the liquid 5 through the spiral pump 2 to the brush wheel 3 and provide a suitable pressure to squeeze the liquid 5 out of the brush wheel 3 from the aperture of the implant hole 31 in the brush wheel 3 along the ditch 321 on the brush hair 32, in which an interferential impeding and strong centrifugal force can be generated by means of the elastic brush hair 32 in the brush wheel 3 and the inner bulge 421 on the notch 42 of the sleeve lid 4, so as to fling off the liquid 5 attached on the brush hair 32 thereby generating the atomized liquid ejection of extremely fine microdrops; as such, the brush wheel typed nebulizer according to the present invention indeed satisfies requirements on innovation, advancement as well as industrial utilization for patent applications.

In summary of the aforementioned illustrations, it is apparent that the present invention achieves the intended enhancement effects based on breakthroughs of prior art technical structure, and is not conveniently considered by those skilled ones in the art. At the same time, the advancement and practical utilization features of the present invention demonstrate fulfillment to conditions required by inventive patent application, thus herein submitting the present application in accordance with relative codes or laws for legal protections.

The aforementioned embodiments are disclosed to illustrate the technical conceptions and features of the present invention, which are intended to let those skilled ones in the art be able to thoroughly appreciate the contents of the present invention and accordingly engage in implementations, rather than limiting the scope of the present invention thereto. Therefore, all effectively equivalent changes or modifications made based on the inventive spirit of the present invention as previously disclosed are still deemed as encompassed by the scope of the present invention.

What is claimed is:

1. A brush wheel typed nebulizer, particularly suitable for liquid of high viscosity, comprising:

a drive device, including a motor and a gear shifting mechanism, in which the gear shifting mechanism is disposed in front of the motor and configured with a buckling part;

a spiral pump, installed on the gear shifting mechanism of the drive device and comprising a body, an outer sleeve, in which the outer periphery of the body is installed with at least a helicoid member closely attached to an inner sleeve having a flow opening inside the outer sleeve, and in which an end of the body is configured with an axis, and an end of the axis is configured with a combination part corresponding to the buckling part of the gear shifting mechanism in the drive device;

a brush wheel, closely fixed in wrap to the exterior of the helicoid member of the spiral pump and the axis thereof, wherein the brush wheel has a U-shaped inner wall and an axial hole is configured at the center in order to correspond to the exterior of the helicoid member of the spiral pump and the axis thereof, and also multiple implant holes are configured on the brush wheel and brush hairs having at least a ditch are disposed in the implant holes, in which the brush hair and the helicoid member of the spiral pump are formed in a symmetric spiral line arrangement; and a sleeve lid, installed on the exterior of the brush wheel, in which, at the center thereof, an axial hole corresponding to the axis of the body of the spiral pump is configured, a notch is configured on the sleeve lid in correspondence with the end of the brush hair in the brush wheel, and an inner bulge is installed at the lower part on one side of the notch, which can act conjunctively with the brush hair end and have multiple guide grooves.

2. The brush wheel typed nebulizer according to claim 1, wherein the brush hair end of the brush wheel is configured with a conical head.

3. The brush wheel typed nebulizer according to claim 1, wherein the gear shifting mechanism consists of multiple mutually engaged worms, worm gears or spur gears.

4. The brush wheel typed nebulizer according to claim 1, wherein the buckling part in the gear shifting mechanism of the drive device is a star-shaped gear groove.

5. The brush wheel typed nebulizer according to claim 2, wherein the buckling part in the gear shifting mechanism of the drive device is a star-shaped gear groove.

6. The brush wheel typed nebulizer according to claim 1, wherein the combination part of the spiral pump is in a star-shaped gear profile.

7. The brush wheel typed nebulizer according to claim 2, wherein the combination part of the spiral pump is in a star-shaped gear profile.

8. The brush wheel typed nebulizer according to claim 1, wherein the brush hair of the brush wheel is elastic.

9. The brush wheel typed nebulizer according to claim 2, wherein the brush hair of the brush wheel is elastic.

10. The brush wheel typed nebulizer according to claim 1, wherein the guide groove of the inner bulge in the sleeve lid is a triangular guide groove.

* * * * *